United States Patent [19]

Berset

[11] Patent Number: 4,459,064

[45] Date of Patent: Jul. 10, 1984

[54] ELONGATED UNDERGROUND CONSTRUCTION HAVING A UNIFORM SECTION AND METHOD OF BUILDING THIS CONSTRUCTION

[76] Inventor: Jean-Marie Berset, Route de la Gare 112, Chénens, Switzerland

[21] Appl. No.: 377,036

[22] Filed: May 11, 1982

[30] Foreign Application Priority Data

May 12, 1981 [CH] Switzerland ..... 3092/81

[51] Int. Cl.[3] ..... E21D 9/04

[52] U.S. Cl. ..... 405/138; 405/145; 405/150; 405/288

[58] Field of Search ..... 405/138, 150, 272, 275, 405/278, 288, 145

[56] References Cited

U.S. PATENT DOCUMENTS

| | | | |
|---|---|---|---|
| 2,067,493 | 1/1937 | Kinzie | 405/150 |
| 2,099,543 | 11/1937 | Stevens | 405/275 |
| 3,855,801 | 12/1974 | Bernold | 405/150 |
| 4,009,579 | 3/1977 | Patzner | 405/138 |
| 4,369,002 | 1/1983 | Kostylev et al. | 405/138 |

FOREIGN PATENT DOCUMENTS

| | | | |
|---|---|---|---|
| 871426 | 2/1953 | Fed. Rep. of Germany | 405/275 |
| 2457736 | 6/1976 | Fed. Rep. of Germany | 405/150 |
| 872768 | 10/1981 | U.S.S.R. | 405/288 |

*Primary Examiner*—David H. Corbin

*Attorney, Agent, or Firm*—Karl F. Ross; Herbert Dubno

[57] ABSTRACT

The reinforced concrete structure of this construction comprises tubular elements of permanent shuttering, connected by structural parts defined by external pile planks and internal permanent shuttering tangential to the tubular elements. The method of building consists in driving in the tubular elements and the pile planks over the entire length of the construction, emptying the tubular elements of the earth with which they are filled, reinforcing and casting concrete into these elements, excavating the interior of the section defined by these tubular elements and the pile planks, progressively disposing props, inserting the inner shuttering between these props and these tubular elements and subsequently reinforcing and casting concrete between this shuttering and the pile planks.

5 Claims, 7 Drawing Figures

FIG. 1
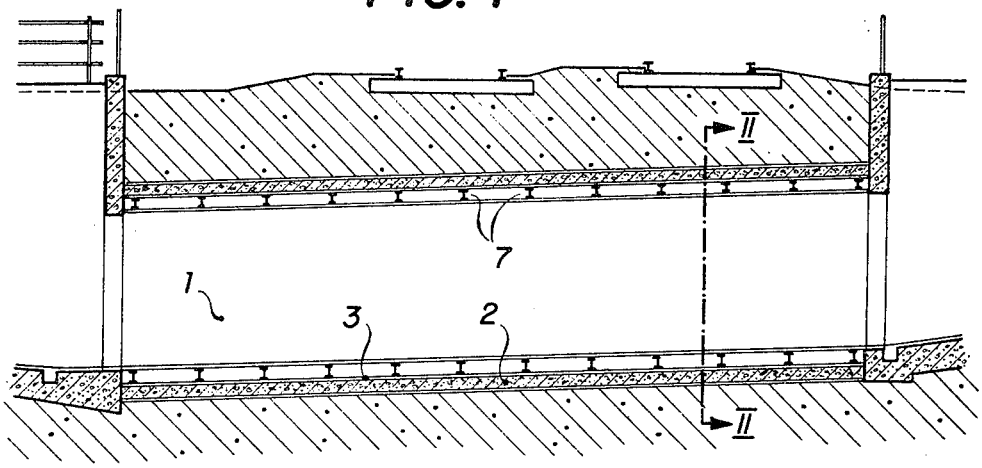
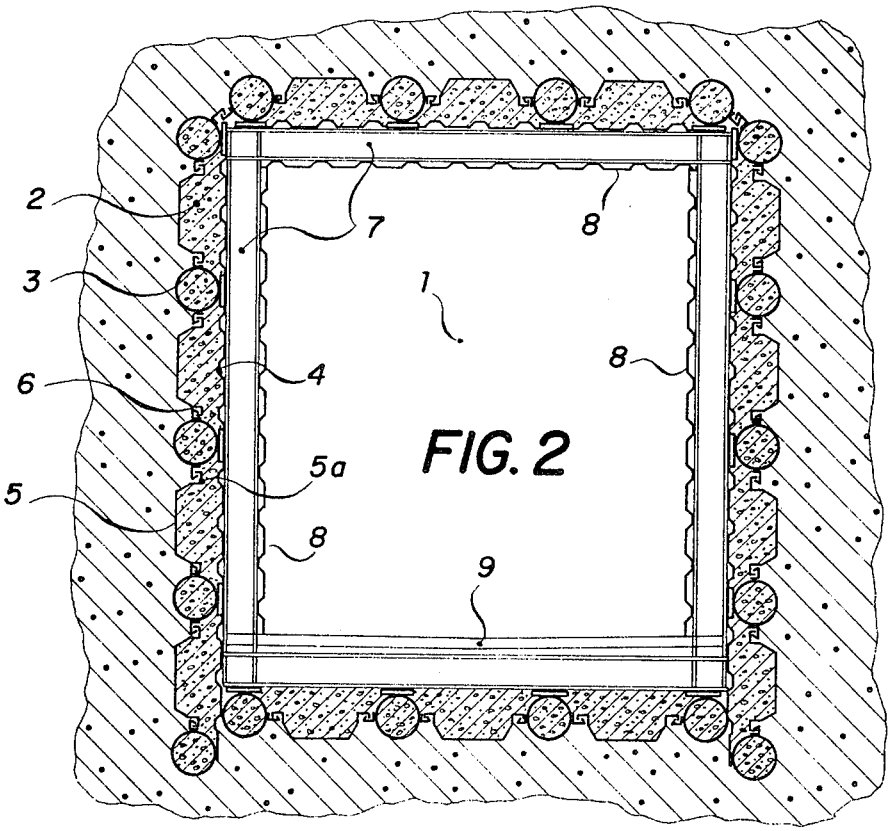
FIG. 2

FIG. 3
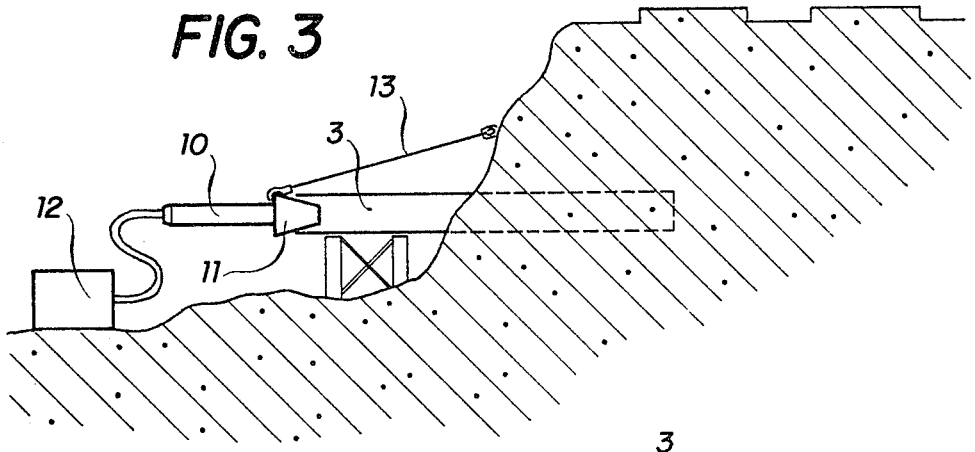
FIG. 4
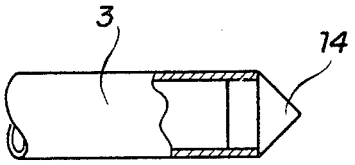
FIG. 5
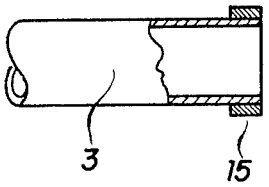
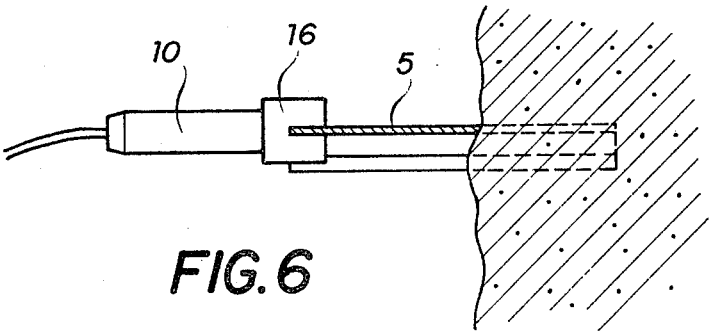
FIG. 6

ELONGATED UNDERGROUND CONSTRUCTION HAVING A UNIFORM SECTION AND METHOD OF BUILDING THIS CONSTRUCTION

FIELD OF THE INVENTION

The present invention relates to an elongated underground structure having a uniform structure and comprising a reinforced concrete structure surrounding at least a part of the cross-section of this construction forming an open space above its base, and to a method for building this structure.

BACKGROUND OF THE INVENTION

The building of underground structures, in particular passages under operational traffic lanes, roads or railways, presents problems owing to the fact that the traffic must be able to continue while the work is performed. This building work requires a great number of precautions and in particular forces the traffic, particularly railway traffic, to slow down.

It has already been proposed, in the Swiss Patent Specification No. 442404, to form a hollow reinforced concrete structure which has a parallelepipedal shape and is axially open and the cross-section of which corresponds to that of the underground passage. The front edge of this structure is formed with a cutting edge such that it is able to be driven into the ground over a certain length by means of jacks. The part of the ground inside this hollow structure is subsequently excavated. When the excavation process has reached the front end of the reinforced concrete structure it is again driven in over a certain length, then the enclosed material is excavated, and so on until the passage has been completely cut.

Although this solution is intended to overcome the problems which are inherent in the cutting of an underground passage below an operational traffic lane by avoiding the slowing-down of traffic while work is in progress, the implementation thereof requires a considerable amount of equipment, in particular the installation of high-power jacks as well as structures which are able to support these jacks. The continuous advancing of the reinforced concrete structure also presents problems with respect to the length of the jacks since the hollow structure advances while the supporting constructions remain stationary. In addition, the required pressure is very great in view of the friction surface which increases as this structure is driven in. Consequently, this solution presents relatively complex problems with respect to implementation which make it expensive owing to the additional work necessitated by the structures which support the jacks. Although it cannot be denied that a solution of this type enables the problem of cutting a passage under an operational traffic lane without slowing down the traffic to a great extent to be overcome, this involves considerable practical difficulties and an increase in the building costs.

It has already been proposed in U.S. Pat. No. 4,009,579 to drive in adjacent tubes which are disposed essentially horizontally in the ground and are intended to extend longitudinally at the location where the upper part of an underground structure will be defined. Subsequently excavation is performed below the zone which is covered by tubes and, as this work progresses, props are arranged in the form of frames which are formed by means of reinforced concrete girders directed along the successive cross-sections of this construction. The sequence of these frames adjacent to one another thus forms a continuous wall. These frames are interconnected by mortar injected into the space separating these frames, on the one hand, from the tubes and, on the other hand, from the surface excavated in the ground.

The substantially prefabricated building of this structure is relatively slow. The positioning of the adjacent frames is complicated owing to the fact that the excavation of the ground is not precisely defined and thus requires each frame to be propped up. The filling with mortar of the spaces occurring between the excavated volume and the frames involves additional consumption of cement while the connection of the frames by means of mortar imparts relatively low strength to the construction such that the frames at the end of the passage have to be axially retained by a support structure.

Thus the above solution is neither technically nor economically satisfactory.

The German Offenlegungschrift No. 1759309 likewise relates to the building of an underground construction which is carried out by means of tubes arranged adjacent one another in the section which is to form the ceiling of the construction and connected to one another by tension elements anchored to these tubes. These tubes are positioned by being driven into the ground, after which a volume is excavated below these tubes. As excavation progresses these tubes are supported by means of props in the form of frames arranged along the cross-section of the construction. These tubes are filled with prestressed concrete and the empty spaces remaining between them are filled with sprayed concrete. The interior of the construction is then provided with conventional masonry. This document does not specify of what the load-bearing structure consists or the nature of the internal masonry, whether it is simply a covering or a reinforced wall. Nevertheless it does not seem possible that the load-bearing structure only comprises tubes filled with prestressed concrete, owing to the lack of cohesion of a construction of this type, each girder being independent of the adjacent girder, and on account of the absence of lateral bearing walls. The masonry works necessary for finishing and the nature of which is not specified should be great. Finally, the fixing of the tension elements anchored to the tubes in order to connect them to one another presupposes that the tubes have a diameter sufficient to enable a man to pass therethrough in order to carry out this work. As these tubes are subsequently filled with concrete the volume of concrete required is considerable. Furthermore, these very large concrete cylinders rest on the masonry structure which is to be the support and therefore require large-scale casing and reinforcing works. This solution is technically and economically ill-suited to the problem of the building of an underground construction.

It is proposed in Belgian Pat. No. 872754 to drive tubes into the ground in order to form a vault resting on walls at its two lateral ends, prestressed concrete girders being formed transversely in order to support these tubes filled with concrete, after which the construction is excavated. This method presupposes that the tubes have a diameter sufficient to enable a man to move about therein, all the masonry work, including the walls supporting the vault, being finished when excavation is peformed.

These solutions often only provide a relative simplification of the building of an underground construction, require the assembly and dismantling of formwork or presuppose that the tubes have a large diameter, and are ill-suited to the building of passages under roads, for example. The limits of the volume to be excavated are only defined in the above-mentioned Belgian patent specification and in this case the concrete walls supporting the vault have to be formed before excavation, which, apart from the tubes with a large diameter, requires galleries to be cut which presents problems with respect to the removal to the exterior of the materials produced by ecavation of the galleries and the volumes defining these bearing walls. Evidently, a method of this type is not suitable for the building of constructions such as passages under roads.

OBJECT OF THE INVENTION

The object of the present invention is to overcome at least some of these disadvantages and to provide at the same time a solution which is technically advantageous per se, both with respect to the building of underground passages under operational traffic lanes and to the cutting and building of any elongated underground structure having a uniform section.

SUMMARY 0F THE INVENTION

To this end, the present invention provides an elongated underground structure having a uniform section and comprising a reinforced concrete structure surrounding at least the part of the cross-section of this construction forming a free space above the base thereof, this structure comprising cylindrical girders of concrete injected into tubes which extend parallel to one another in the longitudinal direction of this construction, as well as props in the form of frames arranged transversely inside this structure, characterised in that these tubes are separate from each other and are connected to one another by means of permanent shuttering elements each of which is engaged with two adjacent tubes in order to define the external face of a reinforced concrete wall, internally defined by further permanent shuttering elements disposed between these tubes and the said props which are spaced longitudinally from each other.

This invention also provides a method of building this underground construction, characterised in that, in rotation about the cross-section of the construction, the said tubular elements and the permanent shuttering elements connecting these tubular elements are successively driven in for a certain depth and if necessary this cycle is repeated until the total depth corresponds to the length of the construction, the said tubular elements are filled with reinforced concrete, the space defined by these tubular elements and the shuttering elements connecting them is excavated, the said props are positioned as this construction is excavated, further permanent shuttering elements are inserted between these props and the tubular elements and the spaces defined by the shuttering elements which connect the tubular elements and those tangential thereto are filled with reinforced concrete.

This invention provides numerous advantages, among which it should be noted that a lining is formed around the cross-section of the passage and over the entire length thereof, before excavating, this lining being reinforced by concrete girders over the entire length of this construction. The lining formed in this way firstly is used to define the volume to be excavated and subsequently as permanent or "lost " shuttering in order to form the load-bearing structure incorporating the reinforcement girders of the lining. The props installed during the course of excavation to support the longitudinal girders are likewise used for fixing the shuttering elements defining the internal face of the load-bearing structure, such that this structure is obtained, after reinforcement, merely by injecting concrete into the shuttering which was previously used to define the excavated volume. This method therefore combines great simplicity with a technically reliable solution.

BRIEF DESCRIPTION OF THE DRAWING

FIG. 1 is a longitudinal section of one embodiment of an underground passage;

FIG. 2 is a section along lines II—II of FIG. 1;

FIG. 3 is a lateral elevation of a detail illustrating a stage of the process;

FIGS. 4 and 5 are partially sectioned fragmentary elevational views which show two variants of a structural detail;

FIG. 6 is an elevation of another detail; and

SPECIFIC DESCRIPTION

Figure 7:
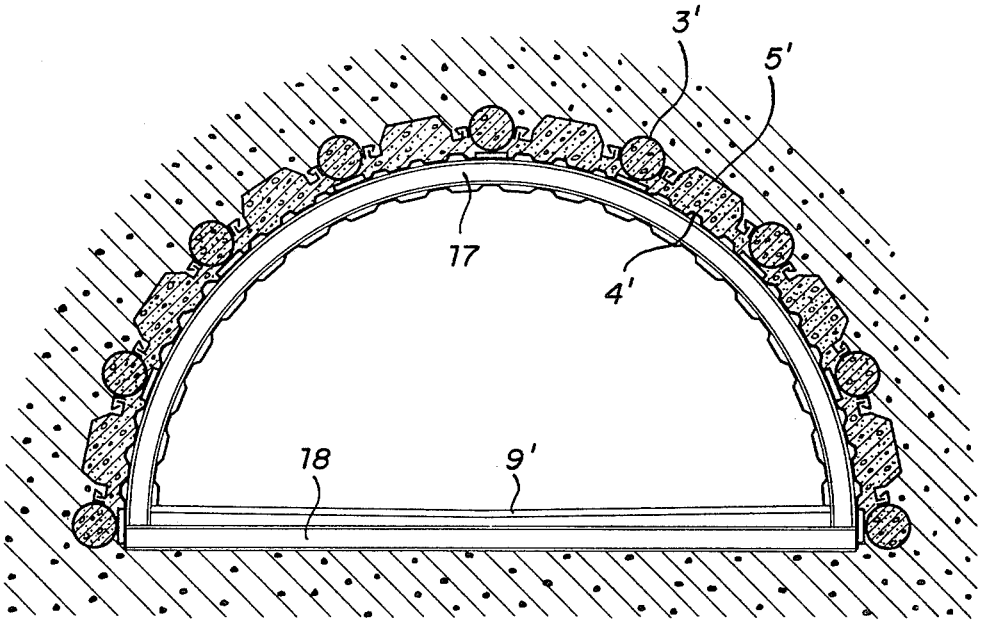
FIG. 7 is a variant of FIG. 2 in transverse section.

The structure shown in FIGS. 1 and 2, consists of an underground passage comprising a reinforced concrete shell 2 surrounding the cross-section of this passage 1. This reinforced concrete structure is formed on the one hand internally by tubular elements 3 acting as permanent shuttering and extending longitudinally to the passage 1 and distributed around the cross-section thereof, as illustrated in FIG. 2. Moreover, this structure is defined internally by permanent shuttering 4 tangential to the tubular elements and formed by metal sections protected against corrosion, and externally by pile planks 5, the longitudinal edges of which have sections **5*a* which are engaged in longitudinal guides 6 fixed in substantially diametrically opposite positions against the external face of each tubular element 3. Props 7, connected in such a manner that they form frames arranged at substantially equal distances from one another inside the reinforced concrete structure 2, extend in respective planes corresponding to the cross-section of the passage 1. The lateral walls and the ceiling of this passage are formed by profiled metal sheets 8 secured to the interior of the props 7 of the frames. The base of the passage is provided with a floor which is covered with a covering 9**.

The method of constructing this passage comprises firstly driving in the tubular elements 3 and the pile planks 5 one after the other over a certain length. The tubular elements 3 and the pile planks 5, moreover, may be dimensioned such that their length corresponds to the desired depth of the driving-in, for example 10 to 12 meters. The guides 6 and the edges **5*a* of the pile planks 5 are engaged with one another in order to ensure that they are guided as they are driven into the ground. This driving-in is peformed by means of a horizontal pneumatic ramming device 10 which is schematically illustrated in FIG. 3. This device comprises a cylinder containing a free piston of between 20 and 160 kg driven in a reciprocating manner at a frequency between 320 and 460 Hz according to the model and supplied with compressed air from a compressor 12 at a pressure of 6 bar. The air consumption is between 1 and 6 $m^3$/min and the power produced is between 7 and 85 kpm. The diameter of the cylinder containing the piston is between 70 and 15 mm depending on the model and its end terminates in an adaptor cone 11 for fitting to the tubular element 3 having a diameter between 140 and 400 mm. This ramming device, is of Russian design, is available in four models sold in Switzerland by the firm R. Lehmann AG 8606 Werrikon b/Uster under the references I.P. 60, I.P. 4605, I.P. 4603 and I.P. 500. In order to drive in the tubular elements 3—in this example these are steel tubes which are 200 mm in diameter, 12 meters in length and whose wall thickness is 4.5 mm—the device 10 is positioned in line with the longitudinal axis of one tubular element 3 and the cone 11 is applied against the end of this tubular element 3, for example by means of bracing cables 13 anchored in the ground and hooked around the base of the adapter cone 11. The device 10 is then supplied with compressed air by the compressor 12. Immediately the ramming begins the adapter cone is wedged in the aperture of the tubular element 3 such that the bracing cables 13** become unnecessary.

Different variants are possible. The front end of the tubular elements 3 may be left open, in which case the earth fills the interior of this tubular element as it is driven in. Depending on the nature of the ground and the length of the passage to be cut the front end of this tubular element 3 may be provided with a conical cap 14 (FIG. 4) which avoids subsequently having to remove the earth from the interior of this tubular element 3. Finally, FIG. 5 shows another variant according to which the front end of the tubular element 3 is surrounded by a collar 15 designed to cut out in the ground a hole the diameter of which is slightly greater than that of the tubular element 3, which enables the frictional forces to be reduced and is useful in particular for cutting passages which are relatively long.

When the tubular element 3 has been partially driven in, a pile plank 5 is arranged by engaging its profiled edge 5*a* in one of the guides welded along the tubular element. At the front of the device 10 the adapter cone 11 is replaced by a slotted template 16 (FIG. 6) designed to receive the rear edge of the pile plank 5 and the latter is driven in in the same manner as the tubular element 3. In this example the distance between the axes of the tubular elements 3 is 65 cm.

In this way each tubular element 3 and each pile plank 5 is driven in successively and partially in an alternating manner until the entire cross-section of the underground passage 1 has been defined by this structure.

In the event of the length of the passage exceeding that of the tubular elements 3 and the pile planks 5, a second tubular element and a second pile plank are added end-to-end to each tubular element and each pile plank driven in at the time of the preceeding ramming operation. In this case the tubular elements, and pile planks, are welded end to end. An operation of this type may be repeated several times until a passage of the desired length is obtained.

The next operation comprises emptying the tubular elements 3 if they have not been provided with conical caps 14, such as the one which is illustrated in FIG. 4. To this end a jet of pressurised water is advantageously used and enables the earth to be fluidised and conveyed to the exterior of the tubular conduit. It is also possible to use compressed air or to push out the plug of earth by means of a piston.

When the tubular elements 3 have been emptied, reinforcement is inserted and concrete is injected under pressure. After this concrete has set the excavation of the earth inside the space defined by the tubular elements 3 and the pile planks 5 is begun. As this excavation process progresses the props 7 are positioned, which props 7 are connected in the form of frames at spacings of 1 meter in this example. The reinforced concrete girders formed in the tubular elements 3 and the props 7 are calculated to resist the stresses which are exerted on this structure during the excavation of the passage. When this operation is terminated the shuttering 4 is inserted between the props 7 and the tubular elements 3, subsequently a reinforcement is introduced in the spaces provided between the pile planks 5 and the shuttering elements 4 and the concrete is injected in order to fill these spaces and thus complete the reinforced concrete structure. The load-bearing structure is thus finished and it remains for it to be lined by means of metal sheets 8 secured to the interior of the cross-pieces and to cover the base with a floor provided with a covering 9.

The building of the underground construction which is the subject of the invention therefore does not require any particular auxiliary substructure apart from the supports for the tubular elements and the pile planks during the initial stage of the ramming process. By way of indication the advance of the tubular elements by ramming is between 8 and 12 cm/min such that a 12 m tubular element may be driven in in approximately two hours.

This invention is of course not limited to a construction having a rectangular section. In addition, it is not necessary in every case for the reinforced concrete structure to extend around the cross-section of the structure, as the base does not have to comprise a structure of this type if this part is not subject to stresses.

The variant illustrated by FIG. 7 shows an underground construction whose section is substantially semicircular. The reinforced concrete structure is identical to that of the passage illustrated in FIG. 2 and comprises tubular elements 3' alternating with the pile planks 5', the structure being limited internally by shuttering elements 4' slipped between the tubular elements 3' and the props, which are each formed by an arch 17 whose ends are maintained separate by a cross-piece 18. The base of the construction does not comprise a reinforced concrete structure but is simply covered with a floor provided with a covering 9'. This variant can obviously be applied to the example of FIG. 2, and conversely it would be possible to construct the variant of FIG. 7 with a reinforced concrete structure having tubes and pile planks around the cross-section of the construction.

I claim:

1. An elongated underground construction having a uniform cross-section and comprising a base with a free volume above the base, and a reinforced concrete structure surrounding at least that part of the cross-section forming the free volume above the base, which structure comprises cylindrical girders consisting of respective tubes extending parallel to one another in the longitudinal direction of the structure and concrete injected into the tubes, these tubes being laterally spaced from one another, first permanent shuttering elements in the form of pile planks which interconnect the tubes and each of which is in engagement with two adjacent tubes, further permanent shuttering elements in the form of pile planks extending between the tubes and spaced inwardly of the first shuttering elements, a reinforced concrete wall defined internally by the further shuttering elements and externally by the first shuttering elements, and props in the form of frames spaced longitudinally from one another and extending transversely to the said structure and engaging said further shuttering elements.

2. An underground construction according to claim 1, wherein each tubular element is provided with diametrically opposed longitudinal guides, and the first shuttering elements have longitudinal edges formed so as to come into engagement with these guides.

3. A method of building an elongate underground construction of uniform cross-section having a base and a free volume above the base, which method comprises:

driving longitudinal tubular elements in an array corresponding to the cross section of said construction at least over that region thereof above the base, driving first longitudinal permanent shuttering elements disposed between and interconnecting the said tubular elements, filling the tubular elements with reinforced concrete, excavating the volume defined by the tubular elements and the first shuttering elements, installing in the excavated volume props in the form of transverse frames, inserting further permanent shuttering elements between the said props and the tubular elements and spaced inwardly from the first permanent shuttering elements, and filling with reinforced concrete the spaces defined between the first shuttering elements and the further shuttering elements.

4. A method according to claim 3, wherein the said tubular elements are open at both their ends as they are driven in, and are subsequently emptied by means of a pressurized fluid before they are filled with reinforced concrete.

5. A method according to claim 3, wherein the tubular elements and the permanent shuttering elements which connect these tubular elements are driven in.

* * * * *